US005163259A

United States Patent [19]

Hunsaker et al.

[11] Patent Number: 5,163,259

[45] Date of Patent: Nov. 17, 1992

[54] INTERLOCKING MANUFACTURED LOGS

[76] Inventors: Theo R. Hunsaker; Analee W. Hunsaker, both of P.O. Box 59, Vernon, Ariz. 85940

[21] Appl. No.: 579,356

[22] Filed: Oct. 29, 1990

[51] Int. Cl.[5] ..... E04B 1/10; E04C 3/30

[52] U.S. Cl. ..... 52/233; 52/592; 52/595

[58] Field of Search ..... 52/233, 309.11, 221, 52/595, DIG. 8, DIG. 592, DIG. 593

[56] References Cited

U.S. PATENT DOCUMENTS

| | | | |
|---|---|---|---|
| 145,221 | 12/1873 | Maitre | 52/592 |
| 3,080,674 | 3/1963 | Amici | 52/392 |
| 3,343,328 | 4/1967 | Rolle . | |
| 3,766,699 | 10/1973 | Dinkel | 52/592 |
| 4,503,648 | 3/1985 | Mahaffey | 52/233 |
| 4,807,413 | 2/1989 | Randall | 52/233 |

FOREIGN PATENT DOCUMENTS

| | | | |
|---|---|---|---|
| 940428 | 8/1948 | France | 52/592 |
| 422275 | 4/1967 | Switzerland | 52/595 |

*Primary Examiner*—David A. Scherbel

*Assistant Examiner*—Kien Nguyen

[57] ABSTRACT

A modular building component made of solid wood, capable of being fitted onto other correspondingly shaped modules to provide a wall of a building. The module includes a core made of horizontally laminated wood with a lengthwise groove cut along the top and vertically at one end for utility purposes, to which side boards are attached in a manner which allows each module to lock into adjoining modules both vertically and horizontally. The upper edges of side boards are attached a short space from the top of the core, the lower edges extending past the bottom of the core, creating both a male and female fitting for adjoining modules. In the same manner side boards are offset a short space from one end of the core and extend past the core at the opposite end to allow the ends of modules to lock as well. The side boards are attached at the factory with adhesive bonding material and secured with fasteners. To form walls, the modules are stacked a row at a time and locked together using adhesive and metal fasteners for which holes have been pre-drilled in the laminated cores.

2 Claims, 3 Drawing Sheets

INTERLOCKING MANUFACTURED LOGS

BACKGROUND OF INVENTION

1. Field of the Invention

To provide an economical, air-tight, bug-proof building "log" which will not twist or crack and will have an even greater insulation quality than ordinary natural logs. The interlocking "log" also utilizes materials which are very inexpensive and available and much of which are presently going to waste.

This invention relates to solid-wood wall construction, specifically a unique interlocking manufactured building module.

2. Background Art

Builders have attempted various ways to make improvements in the solid-wood wall industry with the scarcity of large logs causing concern. Other disadvantages of the traditional log structure are numerous including prohibitive cost, inherent tendencies to warp, twist and split and labor-intensive construction. Various fabricated logs have been produced with some success but the problem of supply still remains, causing grave environmental concerns. Synthetic core materials with outer boards of wood have been suggested under U.S. Pat. No. 4,503,648 to Mahaffey (1985) which might relieve the lumber demand somewhat but would be very unsuitable for structures bearing snow loads, heavy roofs or multi-story structures. Additionally, the polyurethane foam which is in the center of the module has a tendency to lose density over a period of time which could cause the module to collapse. There is also risk that with normal structural movement the side and top boards can shift and separate. Toxic gases given off by the polyurethane are considered to be hazardous as well. U.S. Pat. No. 3,343,328, Rolle (1967) attempts a solid-wood wall modular system which has the disadvantages of butt joints, the twisting and cracking of solid timber which causes air and bug infiltration and weakened structure. The solid timber limits the exterior and interior finish to one species of wood and one finish. Installation of utility lines continues to be as difficult and tedious as in the traditional log construction and most importantly, continued availability of full-sized logs is questionable.

SUMMARY

Accordingly, the reader will see that the invention produces a solid-wood wall component which may simulate logs or may have a variety of other finish aspects for walls, ceilings, and floors and can be easily assembled to produce a log structure or a structure of other perspectives of solid wood with all the inherent benefits including exceptional strength and insulative qualities. The module is capable of being readily attached to existing structures of varied building compositions for add-ons. The module includes lumber laminated horizontally which forms the core of the component, after which side boards or material of other origins are attached to provide interior and exterior facings. This outside facia provides a locking system of a male top portion and a bottom female portion, with corresponding male and female ends to each module for mating both vertically and horizontally as modules stack together to form a very rigid wall, floor or ceiling. Fastening is achieved with vertical lag screws at varied intervals to produce a tight mating of adjoining modules top to bottom and end to end. The screws are inserted through a pre-drilled module into the module underneath drawing them tightly together. Several objects and advantages of the invention are:

(a) to provide a building component which has a horizontal and vertical locking feature incorporated into each module creating a weather-tightness unexcelled in similar construction.

(b) to provide a component which is environmentally safe and compatible for installer and user.

(c) to provide a building component which is affordable using low-grade wood which is presently largely unused and going to waste.

(d) to provide a building component which can be installed with great ease and speed by those possessing moderate to low-skill levels allowing for more common use than most building materials.

(e) to provide a building component which can be installed for a temporary or permanent structure equally as effectively.

(f) to provide for extremely high energy efficiency in all climate extremes.

(g) to provide a building component which can be produced with a variety of exterior and interior finishes allowing great versatility for the builder.

(h) to provide a log-look when desired without the twisting or cracking inherent in natural logs.

(i) to provide a more feasible, less time-consuming method of installing utility lines.

Further advantages of the invention are that the interlocking system surrounds and locks windows and doors into the wall structure as the female ends of modules secure them. The module readily locks onto wood or concrete floors, and the modules can be used for the manufacture of mobile and modular homes. Still further objects and advantages will become apparent from drawings which have been submitted.

DESCRIPTION OF A PREFERRED EMBODIMENT

Figure 1:
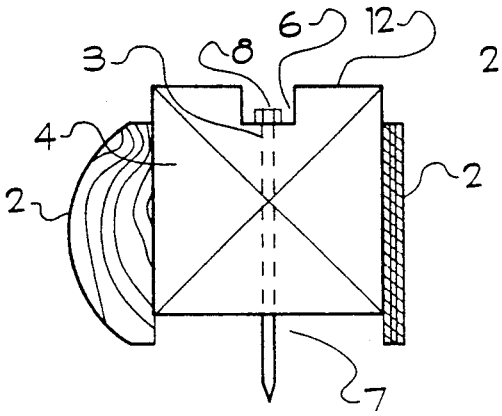
FIG. 1 shows an end view of the building module described in the invention.
Figure 3:
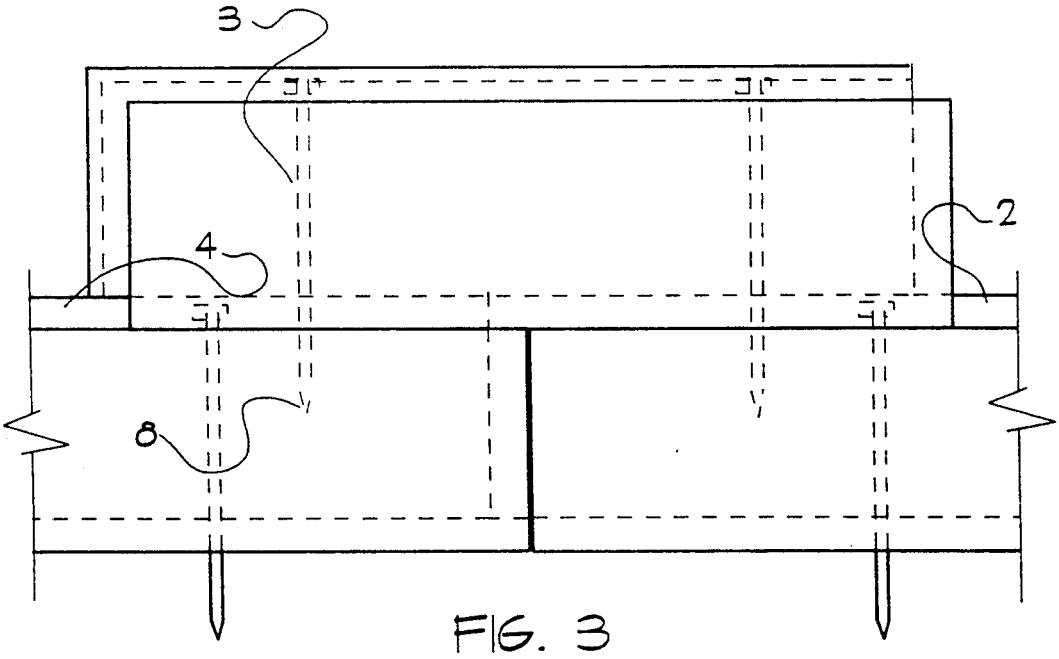
FIG. 3 is an elevation view of stacked modules in a partial wall assembly.
Figure 4:
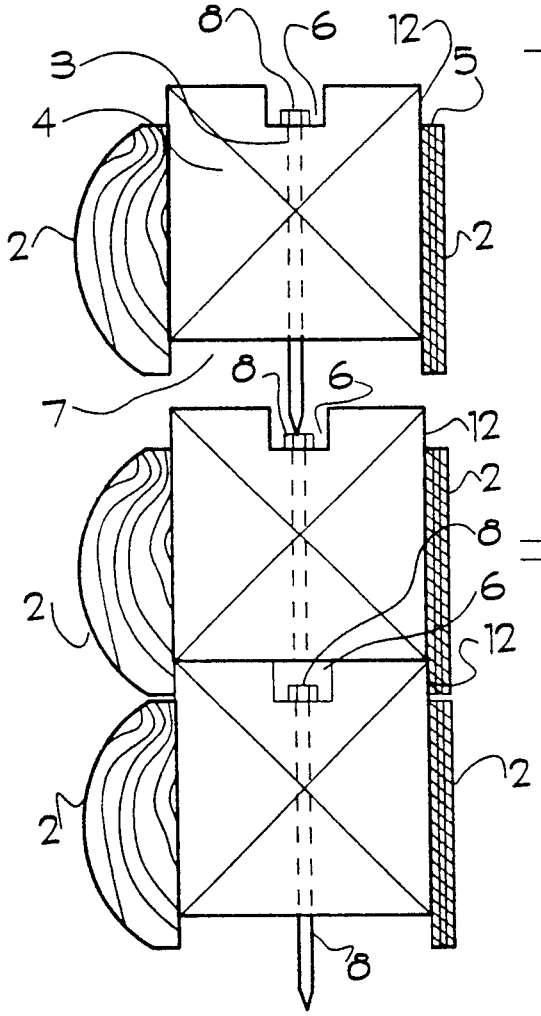
FIG. 4 is an end view of stacked modules.

Referring in more detail to FIG. 1 which shows an end view of the building component described in this invention, the reference 12 of FIG. 1 illustrates a male top 12 of module created by a pair of side boards 2 attached to core 4 in an offset position to form a female bottom 7 to allow a horizontal mating and locking of two building modules as illustrated in FIG. 4. Said side boards 2 are fastened to laminated solid wood inner core 4 by nailing and gluing at the factory. As modules are stacked as illustrated in FIG. 3 and FIG. 4, a bolt fastening device 8 is inserted into a pre drilled hole 3 and mechanically tightened to draw the two modules into a mating position as shown in FIG. 4. FIG. 1 also shows a utility channel 6 which continues the full length of the upper edge of each module and vertically at one end of each.

Figure 2:
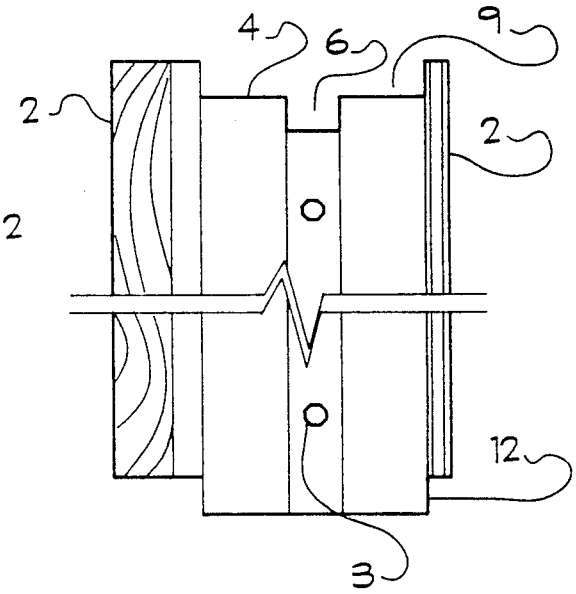
FIG. 2 is a top view of module showing the basic female and male ends which form the locking design.

FIG. 2 A top view of module described in this patent showing a pair of side boards 2 extending an equal distance past core. on each side forming a female end 3, resulting in the formation of a male locking end 12 at the opposite end of module with core protruding out from sideboards the same distance. View also shows vertically pre drilled holes 3 through center of core for receiving fasteners which draw modules tightly together in a horizontal stacking and mating position.

FIG. 3 A partial wall assembly with modules stacked and securely fastened according to this invention with fasteners 8 extending vertically through pre drilled holes 3 into the solid core 4 of lower module and securing two modules together firmly sealing side boards 2.

FIG. 4. End view of stacked modules as described in FIG. 1 and FIG. 3 illustrating a wall formation with utility channel 6 in each core 4 and with fasteners 8 locking modules in a mating position facilitated by offset placement of side boards 2 installed in accordance with this patent.

Figure 5:
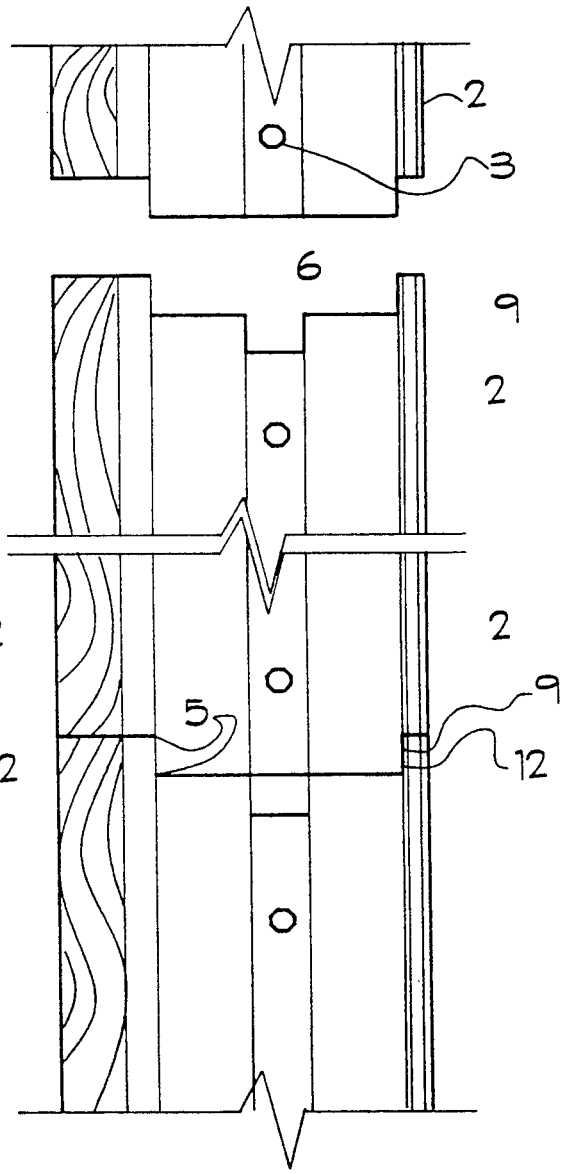
FIG. 5 is a fragmented top view of modules showing locking position showing vertical mating.

FIG. 5. A fragmented top view of modules in a mated position in accordance with FIG. 2 and FIG. 3 of these illustrations with male end 12 and female end 9 mated and drawn together forming a layer of a wall and having pre drilled holes 3 to receive fasteners 8 as described in FIGS. 1, 3 and 4 of this invention and showing vertical utility channel 6.

Figure 6:
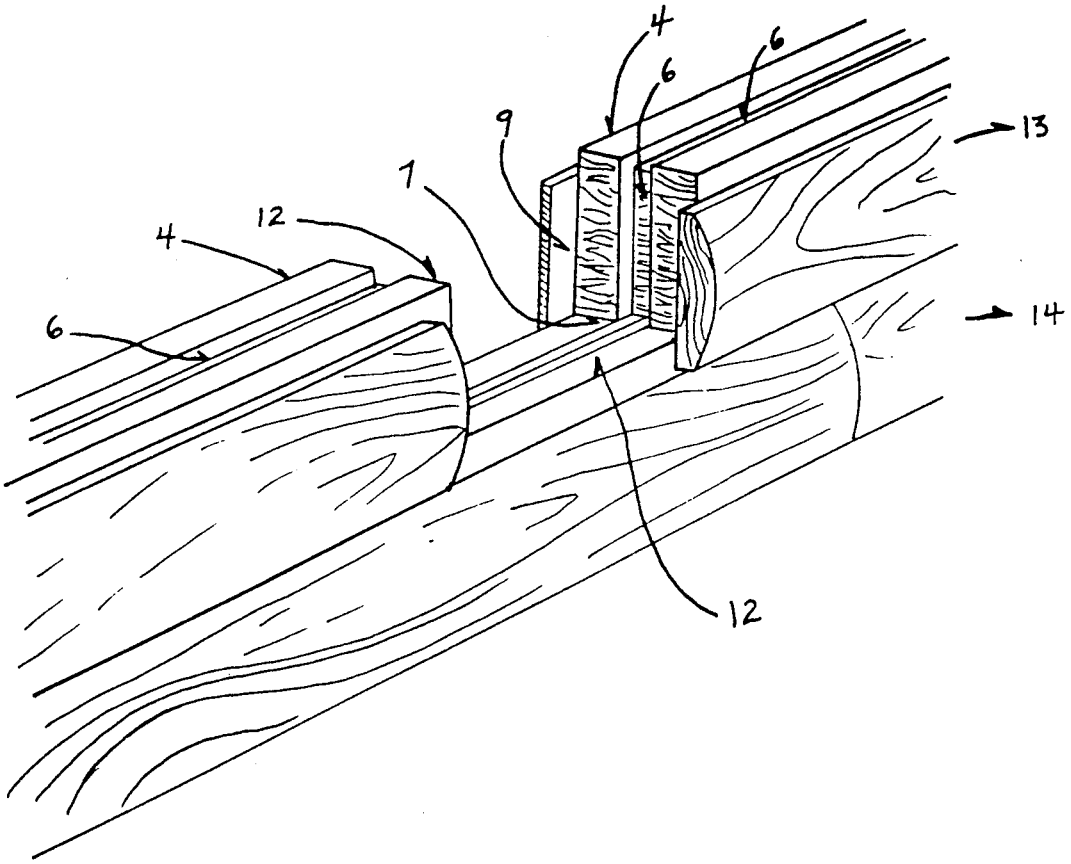
FIG. 6 is a perspective of stacked modules showing both horizontal and vertical locking ability.

FIG. 6. is a perspective view illustrating the modules stacked together with female bottom 7 of upper module 13 fitting horizontally onto male top 12 of lower module 14 and male end 12 ready to slide into female end 9 of upper module 13 to form the vertical locking position of the module. FIG. 6 also shows the utility channel 6 which runs horizontally along top of core 4 of each module and vertically 6 at end of module.

Having previously submitted description of the invention, the following claims are made on said documents.

1. A wall structure formed of modular building components, each of said components being secured to an adjacent component by a vertical fastening means, and each of said modular building components comprising:

(a) a center core having front and back major faces, horizontal upper and lower edges and vertical side edges, said center core having a first utility channel provided in at least one of said horizontal edges, and a second utility channel provided in at least one of said vertical edges, said first utility channel being sized and shaped to receive a utility means and said vertical fastening means; and (b) a side board attached to each of said two major faces of said core, each board extending beyond one of said horizontal edges and one of said vertical edges and terminating short of the other of said vertical edges and the other of said horizontal edges whereby the side boards of each modular building component overlaps the core of an adjacent modular building component in said wall.

2. The wall structure of claim 1 wherein at least one of said side boards is curved to simulate a log wall.

* * * * *